US009683742B2

(12) United States Patent
Takatsu

(10) Patent No.: US 9,683,742 B2
(45) Date of Patent: Jun. 20, 2017

(54) PRESSURE SENSOR INTEGRATED GLOW PLUG

(71) Applicant: Bosch Corporation, Tokyo (JP)

(72) Inventor: Katsumi Takatsu, Saitama (DE)

(73) Assignee: Bosch Corporation, Tokyo (JP)

( * ) Notice: Subject to any disclaimer, the term of this patent is extended or adjusted under 35 U.S.C. 154(b) by 288 days.

(21) Appl. No.: 14/418,309

(22) PCT Filed: Jun. 20, 2013

(86) PCT No.: PCT/JP2013/066942

§ 371 (c)(1),
(2) Date: Jan. 29, 2015

(87) PCT Pub. No.: WO2014/024576

PCT Pub. Date: Feb. 13, 2014

(65) Prior Publication Data

US 2015/0300643 A1 Oct. 22, 2015

(30) Foreign Application Priority Data

Aug. 9, 2012 (JP) ..... 2012-176758

(51) Int. Cl.
*H05B 1/00* (2006.01)
*F23Q 7/22* (2006.01)
*F23Q 7/00* (2006.01)

(52) U.S. Cl.
CPC ..... *F23Q 7/001* (2013.01); *F23Q 2007/002* (2013.01)

(58) Field of Classification Search
CPC ..... H05B 3/00; H05B 3/0004; H05B 3/0009; H05B 3/0014; H05B 3/0019;
(Continued)

(56) References Cited

U.S. PATENT DOCUMENTS 5,085,049 A * 2/1992 Rim ..... F01N 3/02 55/466
6,040,519 A * 3/2000 Kita ..... F23Q 7/001 136/227

(Continued)

FOREIGN PATENT DOCUMENTS

JP 2000329344 11/2000
JP 2009520941 5/2009

(Continued)

OTHER PUBLICATIONS

International Search Report for Application No. PCT/JP2013/066942 dated Jul. 23, 2013 (English Translation, 2 pages).

*Primary Examiner* — David Angwin
*Assistant Examiner* — Gyounghyun Bae
(74) *Attorney, Agent, or Firm* — Michael Best & Friedrich LLP

(57) ABSTRACT

A pressure sensor integrated glow plug inserted inside a cylinder of an internal combustion engine and used, the pressure sensor integrated glow plug being equipped with a housing, a rod-like heater element held with its distal end projecting from the housing, and a pressure sensor, with the heater element being held in the housing by a flexible member and configured in such a way that its position relative to the housing is displaceable, and with the pressure sensor being configured in such a way that it can receive pressure inside the cylinder because of the displacement of the heater element, wherein a heat-resistant fiber member carrying an oxidation catalyst component is disposed in an interstice between the housing and the heater element on the distal end side of the flexible member.

8 Claims, 3 Drawing Sheets

(58) Field of Classification Search
CPC .. H05B 3/0023; H05B 3/0028; H05B 3/0033; H05B 3/0038; H05B 3/0042; H05B 3/004; H05B 3/0047; F23Q 7/001; F23Q 2007/002; H01L 23/345; H01L 24/81; H01L 2924/14; H05K 1/0212; H05K 3/3494
USPC ..... 219/209, 260, 267, 270, 205; 73/23.31, 73/35.12, 35.13, 114.01, 114.1, 114.13, 73/114.16, 114.18, 114.19, 114.21, 73/114.51, 708, 714, 715, 756; 123/143 A, 145 A, 145 R, 256, 435, 623, 123/179.21; 701/103, 104; 702/182; 60/602, 274, 295, 286; 244/138 R; 361/807; 374/144; 340/459
See application file for complete search history.

(56) References Cited

U.S. PATENT DOCUMENTS 6,539,787 B1* 4/2003 Murai ..... F02D 35/023 73/114.21
2006/0053875 A1* 3/2006 Haussner ..... F23Q 7/001 73/114.19
2007/0209624 A1* 9/2007 Ludwig ..... G01L 23/10 123/145 A
2007/0245806 A1* 10/2007 Hirose ..... F23Q 7/001 73/35.13
2008/0216786 A1* 9/2008 Ramond ..... G01L 23/22 123/143 A
2008/0302323 A1* 12/2008 Kern ..... G01L 23/22 123/145 A
2009/0126472 A1* 5/2009 Hirose ..... G01L 23/22 73/114.18
2009/0242540 A1* 10/2009 Itoh ..... F23Q 7/001 219/267
2010/0037698 A1* 2/2010 Kern ..... G01L 23/10 73/715
2010/0147822 A1* 6/2010 Burrows ..... F23Q 7/001 219/267
2011/0005308 A1* 1/2011 Kern ..... F23Q 7/001 73/114.16
2012/0011924 A1* 1/2012 Ramond ..... G01L 23/10 73/114.01
2012/0247091 A1* 10/2012 Ogyu ..... F01N 3/0222 60/295
2013/0269640 A1* 10/2013 Nakamura ..... F02P 19/028 123/145 A
2013/0269641 A1* 10/2013 Watanabe ..... F23Q 7/001 123/145 A
2013/0319094 A1* 12/2013 Nakamura ..... G01M 15/08 73/114.19

FOREIGN PATENT DOCUMENTS

JP 2009144702 7/2009
JP 2009203939 9/2009
JP 2010203763 9/2010
WO 2009036724 3/2009

* cited by examiner

PRESSURE SENSOR INTEGRATED GLOW PLUG

BACKGROUND OF THE INVENTION

The present invention relates to a pressure sensor integrated glow plug in which a pressure sensor for detecting the pressure inside a cylinder is integrated into a sheathed glow plug used to aid the starting of a diesel engine.

Conventionally, in diesel engines, which are self-igniting internal combustion engines, glow plugs are disposed inside the cylinders. Furthermore, in recent years, pressure sensor integrated glow plugs, in which a pressure sensor for detecting the pressure inside the cylinder is integrated with the glow plug, have been put into practical use.

For example, a pressure sensor integrated glow plug is configured to include a housing for insertion inside a cylinder, a heater element held in the housing with its distal end projecting from the housing, and a pressure sensor disposed between the heater element and the housing. In this pressure sensor integrated glow plug, the heater element is held in the housing by a flexible member such as a bellows or a diaphragm, the heater element is displaced in an axial direction inside the housing by the pressure inside the cylinder, and the pressure sensor can detect the pressure inside the cylinder because of this displacement.

In such a glow plug, in order to make it possible to stably detect the pressure over a long period of time, the flexibility of the flexible member must be maintained. That is, the heater element must be kept from being mechanically restrained in the section outside the flexible member. However, the glow plug is exposed inside the cylinder and used, and when uncombusted fuel components or the like generated inside the cylinder build up between the heater element and the housing, there is the concern that the heater element will become restrained in the housing and will no longer be able to transmit the pressure inside the cylinder to the pressure sensor.

For that reason, proposals have been made to prevent the build-up of uncombusted fuel components by filling the space between the heater element and the housing with a fluid seal material or coating the surface of the heater element with an oxidation catalyst (e.g., see JP-A-2009-520941 and JP-A-2009-203939).

SUMMARY OF THE INVENTION

However, there has been the concern that when the fluid seal material with which the space has been filled is positioned in the neighborhood of the combustion chamber for a long period of time, its fluidity will be lost. Furthermore, in the case of coating the surface of the heater element with an oxidation catalyst, it is difficult to ensure a sufficient surface area, so there has been the concern that the catalytic activity will be insufficient and that the catalytic combustion of carbon and SOF (soluble organic fraction) that build up will not be able to be performed efficiently.

Consequently, it is an object of the present invention to provide a pressure sensor integrated glow plug that suppresses the build-up of carbon and SOF in the interstice between the housing and the heater element to thereby ensure that the heater element is not restrained over a long period of time.

According to the present invention, there is provided a pressure sensor integrated glow plug inserted inside a cylinder of an internal combustion engine and used, the pressure sensor integrated glow plug being equipped with a housing, a rod-like heater element held with its distal end projecting from the housing, and a pressure sensor, with the heater element being held in the housing by a flexible member and configured in such a way that its position relative to the housing is displaceable, and with the pressure sensor being configured in such a way that it can receive pressure inside the cylinder because of the displacement of the heater element, wherein a heat-resistant fiber member carrying an oxidation catalyst component is disposed in an interstice between the housing and the heater element on the distal end side of the flexible member; and thus the problem described above can be solved.

That is, according to the pressure sensor integrated glow plug of the present invention, carbon and SOF are prevented from entering between the housing and the heater element, and carbon and SOF sticking to the fiber member can be oxidized and broken down by the catalyst component carried on the surfaces of the fibers. At this time, because the fiber member carries the catalyst, a large surface area for carrying the catalyst can be ensured, the catalytic activity can be enhanced, and carbon and SOF can be efficiently broken down. Consequently, the heater element can be prevented from being restrained in the housing over a long period of time.

Furthermore, in the pressure sensor integrated glow plug of the present invention, the heat-resistant fiber member preferably comprises ceramic fibers carrying an oxidation catalyst component.

In this way, by using ceramic fibers to configure the heat-resistant fiber member, due to the heat retention property that a ceramic material has, the catalytic activity can be improved so that the oxidation and breakdown of carbon and SOF can be performed more effectively.

Furthermore, in the pressure sensor integrated glow plug of the present invention, the heat-resistant fiber member is preferably disposed sticking outside the housing from the interstice between the housing and the heater element.

By disposing the heat-resistant fiber member in this way, carbon and SOF that have entered between the insertion hole in the internal combustion engine and the heater element can be oxidized and broken down so that they can be prevented from building up.

DETAILED DESCRIPTION

Figure 1:
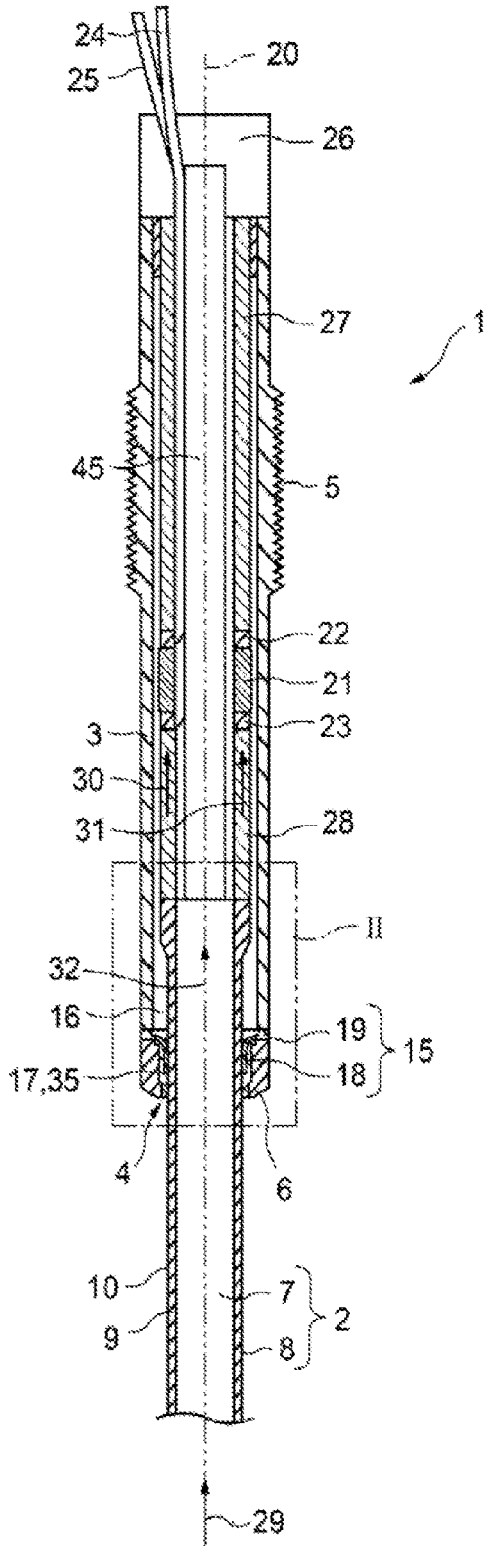
FIG. 1 is a cross-sectional view of a pressure sensor integrated glow plug pertaining to an embodiment of the present invention.

An embodiment relating to a pressure sensor integrated glow plug pertaining to the present invention will be specifically described below on the basis of the drawings.

Unless otherwise indicated, constituent elements to which the same reference signs are assigned in the drawings represent the same constituent elements, and description thereof will be appropriately omitted.

FIG. 1 is a cross-sectional view of a pressure sensor integrated glow plug (hereinafter simply called "glow plug") 1 pertaining to the embodiment of the present invention.

The glow plug 1 shown in FIG. 1 is configured as a sheathed glow plug and, for example, is configured as a glow plug 1 used in a self-igniting internal combustion engine such as a diesel engine.

The glow plug 1 has a rod-like heater element 2; in the case of a pre-combustion internal combustion engine, the heater element 2 is inserted and fixed in a pre-combustion chamber, and in the case of a direct injection internal combustion engine, the heater element 2 is inserted and fixed in a combustion chamber of the internal combustion engine. The heater element 2 can be configured as a heater element 2 made of metal or ceramic. However, the heater element 2 may also have another configuration.

The glow plug 1 has a housing 3. The housing 3 preferably comprises a metal material. The housing 3 has a concentric through hole, and the rear end side of the heater element 2 is partially disposed inside the housing 3 so that the heater element 2 can project inside the combustion chamber or the like of the internal combustion engine from the housing 3 at the place of an opening 4 disposed in the distal end side of the housing 3. Moreover, the housing 3 has a male thread 5, and because of this male thread 5, the glow plug 1 can be screwed into an insertion hole disposed in a housing of the internal combustion engine. At this time, because of a conical seal 6, the glow plug 1 is air-tightly fitted inside the insertion hole disposed in the internal combustion engine.

The rod-like heater element 2 used in the present embodiment has a heating member 7 and a support tube 8. The support tube 8 is in contact with an outer peripheral surface 9 of the heating member 7 and is joined to the heating member 7. An outer surface 10 of the support tube 8 simultaneously also forms an outer surface 10 of the heater element 2.

The concentric through hole disposed in the glow plug 1 is divided into an inner chamber 16 and a seal chamber 17 by a steel diaphragm 15 serving as a flexible member. The steel diaphragm 15 is on one side joined to the housing 3 and is on the other side joined to the support tube 8 of the heater element 2 at a cylindrically annual portion 18. The steel diaphragm 15 has a base portion 19, and the base portion 19 is formed having flexibility so that the heater element 2 can move relatively with respect to the housing 3 in the direction of an axis 20 of the housing 3 of the glow plug 1.

A pressure sensor 21 is disposed in the inner chamber 16. The pressure sensor 21 can be configured as a piezoelectric sensor element, for example. The piezoelectric sensor element generates a charge when it receives a mechanical load, and the charge can be detected in contact regions 22 and 23 of the pressure sensor 21. The detected charge is output from the housing 3 of the glow plug 1 by electric wires 24 and 25. The pressure sensor 21 is supported by a sleeve 27 joined to the housing 3 at an end portion 26 side of the glow plug 1 on the far side from the combustion chamber or the like. At the other side, the pressure sensor 21 is joined to the heater element 2 via a force transmission sleeve 28. In this case, the heater element 2 is mainly supported by the force transmission sleeve 28 at the section of the support tube 8.

In a state in which the glow plug 1 has been installed, a force acting on the heater element 2 is generated on the basis of the pressure inside the combustion chamber or the like of the internal combustion engine. The force acts on the heater element 2 in an axial direction 29, that is, the direction along the axis 20. The force is transmitted to the pressure sensor 21 along a force transmission path indicated by arrows 30, 31, and 32. The pressure sensor 21 outputs a detection signal via the electric wires 24 and 25 in response to the transmitted force, and the pressure that has been formed in the combustion chamber or the like is measured from the detection signal. In order to precisely measure the pressure that has been generated inside the combustion chamber or the like, it becomes necessary to ensure a state in which the heater element 2 and the force transmission sleeve 28 can freely move in the axial direction 29 without being restrained in the housing 3. In this case, when measuring the pressure on the basis of the detection signal of the pressure sensor 21, consideration can be given beforehand, for example, to the effect on the force transmitted to the pressure sensor 21 that arises because of the elastic force of the steel diaphragm 15.

However, it is difficult to give consideration beforehand to the effect of contamination that arises during the operation of the glow plug 1 and particularly in relation to the quantity and effect of contamination that arises in the neighborhood of the opening 4 in the distal end side, so such contamination can become a major cause that leads to mismeasurement of the pressure that has arisen in the combustion chamber or the like. In particular, there is the concern that some of the force that has arisen because of the pressure inside the combustion chamber or the like will end up being transmitted to the housing 3 in the region of the conical seal 6 because of the effect of foreign matter that has built up because of contamination in the neighborhood of the opening 4 in the end portion side and that, as a result, the force that actually acts on the pressure sensor 21 will decrease. This leads to a drop in the detection precision of the pressure that has arisen inside the combustion chamber or the like.

In order to avoid this problem, a heat-resistant fiber member 35 is disposed inside the seal chamber 17 in the glow plug 1 pertaining to the present embodiment. The configuration of the seal chamber 17 as well as the characteristics and action of the heat-resistant fiber member 35 will be described in detail below on the basis of FIG. 2.

Figure 2:
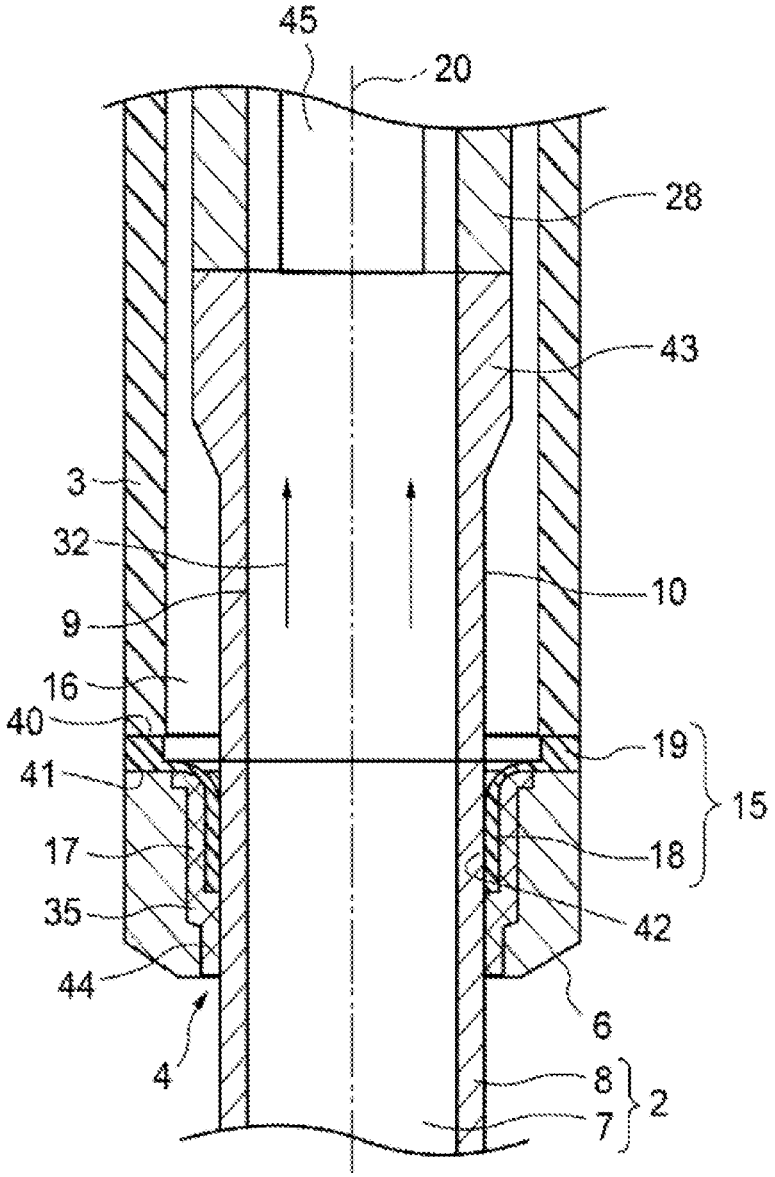
FIG. 2 is a partially enlarged view of the pressure sensor integrated glow plug shown in FIG. 1.

In FIG. 2, a region II indicated by a long dashed double-short dashed line in FIG. 1 is shown in detail. The base portion 19 of the steel diaphragm 15 has an annular surface 40, and the annular surface 40 is joined to the housing 3. Moreover, the base portion 19 of the steel diaphragm 15 has another annular surface 41, and the annular surface 41 faces the opposite direction of the annular surface 40 and is joined to the conical seal 6 of the housing 3. Moreover, an inner surface 42 of the cylindrically annular portion 18 of the steel diaphragm 15 is connected to the outer surface 10 of the support tube 8, and in this case, the steel diaphragm 15 and the support tube 8 are joined together by laser welding, for example, in the range of the inner surface 42. Because of this, a highly reliable seal between the seal chamber 17 and the inner chamber 16 is ensured.

In order to improve the transmission of force from the heater element 2 to the force transmission sleeve 28, the thickness of a region 43 of the support tube 8 near the force transmission sleeve 28 is made to conform to the thickness of the force transmission sleeve 28, so that in this case, the support tube 8 is formed having a greater thickness in the range of the region 43 than in other ranges.

In the region where the conical seal 6 is positioned, an annular gap 44 is disposed between the housing 3 and the outer surface 10 of the heater element 2. The annular gap 44 forms the opening 4 in the end portion side. The annular gap 44 allows the heater element 2 to move in the direction along the axis 20. However, the heater element 2 is configured to receive the action of the elastic force that the steel diaphragm 15 has. In this case, the elastic force that is generated by the steel diaphragm 15 and acts on the heater element 2 via the support tube 8 is measured beforehand, and this elastic force can be taken into consideration when measuring the pressure that has arisen inside the combustion chamber or the like.

Moreover, the heat-resistant fiber member 35 is disposed in the seal chamber 17. The heat-resistant fiber member 35 also fills the annular gap 44. The heat-resistant fiber member 35 comprises, for example, a member in which highly heat-resistant fibers such as ceramic fibers or quartz fibers carry a known catalyst component having a high oxidation capability. The heat-resistant fiber member 35 can be heat-resistant fibers directly carrying a catalyst material or can be heat-resistant fibers holding ceramic particles or the like with a large area in which a catalyst material is carried. Furthermore, the heat-resistant fiber member 35 may be configured in such a way that the seal chamber 17 and the annular gap 44 are filled with an unformed material or in such a way that it is formed beforehand in accordance with the shape of the seal chamber 17 and the annular gap 44 and attached.

The highly heat-resistant fibers are selected from known highly heat-resistant inorganic materials such as crystalline fibers, non-crystalline fibers, mineral wool, and glass fibers, and may also be preformed. Furthermore, the catalyst component can be configured to include one or two or more types of noble metals. Or, a catalyst material comprising a metal oxide whose constituent element is a noble metal can also be used.

Because the heat-resistant fiber member 35 is disposed, carbon and SOF, which are uncombusted materials, can be physically prevented from entering between the housing 3 and the heater element 2. Moreover, carbon or the like sticking to the heat-resistant fiber member 35 is oxidized and broken down by the carried catalyst component and turns into gas, so that solid components can be prevented from building up. Here, the heat-resistant fiber member 35 carries the catalyst component on the fibers, so the surface area in which the catalyst is carried becomes larger so that the catalytic activity can be further enhanced.

Furthermore, particularly when the fibers carrying the catalyst component comprise ceramic fibers or quartz fibers, due to the heat retention effect thereof, the catalytic activity is further enhanced utilizing the heat that the heater element 2 generates, so that carbon and SOF can be effectively oxidized and broken down.

Moreover, the heat-resistant fiber member 35 utilizes fibers, so the fill density is kept low, there is no concern of restraining the heater element 2, and the pressure received by the heater element 2 can be efficiently transmitted to the pressure sensor 21. Moreover, the heat-resistant fiber member 35 also has the function of protecting the steel diaphragm 15 and in particular reducing corrosion of the steel diaphragm 15.

In the embodiment described above, the heat-resistant fiber member 35 may be disposed sticking out from the interstice between the housing 3 and the heater element 2. In a case where the heat-resistant fiber member 35 is disposed in this way, carbon, SOF, and the like that have entered the interstice between the insertion hole disposed in the housing of the internal combustion engine and the heater element 2 can be oxidized and broken down so that they can be prevented from building up.

Figure 3:
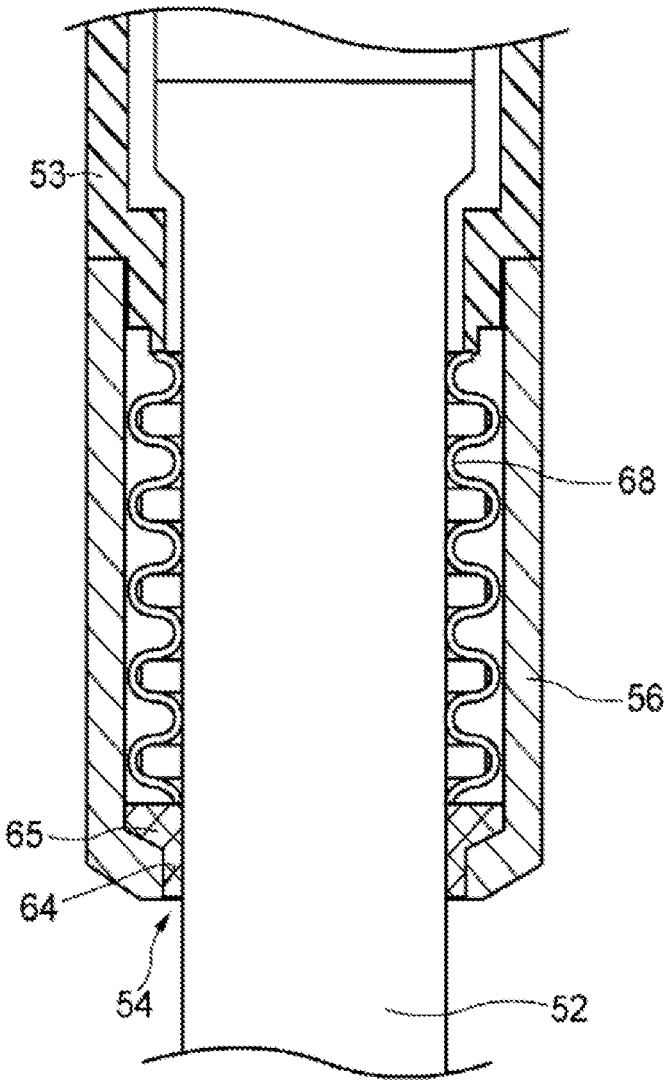
FIG. 3 is a partially enlarged view showing an example modification of the pressure sensor integrated glow plug.

FIG. 3 shows an enlarged view of an example of a glow plug using a bellows instead of a steel diaphragm as the flexible member.

In the example of this glow plug, a bellows 68 is joined to a heater element 52, and the bellows 68 is fixed on one end side thereof to a housing 53. The heater element 52 can move smoothly in the axial direction inside the housing 53. The bellows 68 is preferably formed by a metal material, and the joining of the bellows 68 and the heater element 52 is performed by a method such as laser welding, crimping, swaging, soldering, or press fitting, for example.

In the glow plug of this example modification also, the housing 53 is equipped with a cylindrical seal 56 on its distal end portion, and an annular gap 64 is disposed between the housing 53 and the heater element 52 in the region of the distal end portion of the cylindrical seal 56. The annular gap 64 forms an opening in the end portion side. A heat-resistant fiber member 65 is disposed on the distal end side of the inside of the cylindrical seal 56 including this annular gap.

In this way, even in a case where the bellows 68 is used as the flexible member that holds the heater element 52, by disposing the heat-resistant fiber member 65 carrying the oxidation catalyst component in the interstice between the housing 53 and the heater element 52 on the distal end side, the same effects as those of the glow plug of the embodiment described above can be obtained.

The invention claimed is:

1. A pressure sensor integrated glow plug configured to be inserted inside a cylinder of an internal combustion engine and used, the pressure sensor integrated glow plug comprising: a housing, a rod-like heater element held with a distal end of the heater element projecting from the housing, and a pressure sensor, with the heater element being held in the housing by a flexible member and configured in such a way that a position of the heater element relative to the housing is displaceable, and with the pressure sensor being configured in such a way that the pressure sensor can receive pressure inside the cylinder because of displacement of the heater element, wherein a heat-resistant fiber member carrying an oxidation catalyst component is disposed in an interstice between the housing and the heater element on a distal end side of the flexible member.

2. The pressure sensor integrated glow plug according to claim 1, wherein the heat-resistant fiber member comprises ceramic fibers carrying an oxidation catalyst component.

3. The pressure sensor integrated glow plug according to claim 1, wherein the heat-resistant fiber member is disposed sticking outside the housing from the interstice between the housing and the heater element.

4. The pressure sensor integrated glow plug according to claim 2, wherein the heat-resistant fiber member is disposed sticking outside the housing from the interstice between the housing and the heater element.

5. A pressure sensor integrated glow plug operably inserted inside a cylinder of an internal combustion engine, the pressure sensor integrated glow plug comprising: a housing, a rod-like heater element held with a distal end of the heater element projecting from the housing, and a pressure sensor, with the heater element being held in the housing by a flexible member and configured in such a way that a position of the heater element relative to the housing is displaceable, and with the pressure sensor being configured in such a way that the pressure sensor can receive pressure inside the cylinder because of displacement of the heater element, wherein a heat-resistant fiber member carrying an oxidation catalyst component is disposed in an interstice between the housing and the heater element on a distal end side of the flexible member.

6. The pressure sensor integrated glow plug according to claim 5, wherein the heat-resistant fiber member comprises ceramic fibers carrying an oxidation catalyst component.

7. The pressure sensor integrated glow plug according to claim 5, wherein the heat-resistant fiber member is disposed sticking outside the housing from the interstice between the housing and the heater element.

8. The pressure sensor integrated glow plug according to claim 6, wherein the heat-resistant fiber member is disposed sticking outside the housing from the interstice between the housing and the heater element.

* * * * *